US009815253B2

(12) United States Patent
Murray

(10) Patent No.: US 9,815,253 B2
(45) Date of Patent: Nov. 14, 2017

(54) DUAL COMPARTMENTED POUCH AND METHOD FOR MAKING THE SAME

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 14/699,021

(22) Filed: Apr. 29, 2015

(65) Prior Publication Data

US 2015/0307233 A1 Oct. 29, 2015

Related U.S. Application Data

(60) Provisional application No. 61/985,522, filed on Apr. 29, 2014.

(51) Int. Cl.

| | |
|---|---|
| ***B65D 30/22*** | (2006.01) |
| ***B31B 19/60*** | (2006.01) |
| ***B65D 75/58*** | (2006.01) |
| ***B65D 81/32*** | (2006.01) |
| ***B31F 1/20*** | (2006.01) |
| *B65D 75/00* | (2006.01) |
| *B65B 3/04* | (2006.01) |
| *B65B 39/00* | (2006.01) |

(52) U.S. Cl.

CPC ..... *B31B 19/60* (2013.01); *B31F 1/20* (2013.01); *B65D 31/12* (2013.01); *B65D 75/5883* (2013.01); *B65D 81/3261* (2013.01); *B31B 2219/9054* (2013.01); *B31B 2221/10* (2013.01); *B65B 3/04* (2013.01); *B65B 2039/009* (2013.01); *B65B 2230/02* (2013.01); *B65D 75/008* (2013.01); *B65D 2575/583* (2013.01)

(58) Field of Classification Search

CPC ..... B65D 31/12; B65D 31/14; B65D 31/147; B65D 35/22

See application file for complete search history.

(56) References Cited

U.S. PATENT DOCUMENTS

| | | | | |
|---|---|---|---|---|
| 5,199,594 A * | 4/1993 | Obara | ..... | B65D 31/12 229/117.3 |
| 6,624,130 B2 * | 9/2003 | Giblin | ..... | B65D 75/5811 229/307 |
| 7,055,683 B2 * | 6/2006 | Bourque | ..... | B29C 65/76 206/219 |

(Continued)

*Primary Examiner* — Derek Battisti

(74) *Attorney, Agent, or Firm* — Dinsmore & Shohl LLP

(57) ABSTRACT

A flexible pouch and a method for making a flexible pouch is provided. The pouch includes a pouch body defined by a peripheral edge. A dividing seal is disposed between opposite ends of the flexible pouch so as to define two pouch spaces. The pouch includes two fitments are mounted to a respective pouch space. One of the fitments is configured to support the pouch body in an upright manner. A method for making said flexible includes forming a flexible pouch having an open top. A dividing seal extends from the open top to the bottom of the pouch so as to define two pouch openings and two pouch spaces. Substances are introduced into the pouch spaces by a first nozzle and a second nozzle inserted into a respective first space and second space and filling the pouch body through the first and second nozzle.

6 Claims, 6 Drawing Sheets

(56) References Cited

U.S. PATENT DOCUMENTS

| | | | | |
|---|---|---|---|---|
| 8,668,082 | B2 * | 3/2014 | Greene | B65D 37/00 206/292 |
| D703,440 | S * | 4/2014 | Terrell | D3/289 |
| 9,334,087 | B2 * | 5/2016 | Cho | B65D 81/3484 |
| 2002/0130138 | A1 * | 9/2002 | Crozet | B65D 81/3261 222/94 |
| 2005/0109796 | A1 * | 5/2005 | Bourque | B65D 81/3261 222/94 |
| 2005/0161424 | A1 * | 7/2005 | Hogan | B65D 21/0202 215/10 |
| 2010/0142862 | A1 * | 6/2010 | Sam | B65D 31/12 383/38 |
| 2012/0269462 | A1 * | 10/2012 | Itiyanagi | B65D 33/2508 383/64 |
| 2015/0158635 | A1 * | 6/2015 | Gum | B65D 75/008 383/25 |
| 2015/0210436 | A1 * | 7/2015 | Murray | B65D 31/12 383/38 |

* cited by examiner

DUAL COMPARTMENTED POUCH AND METHOD FOR MAKING THE SAME

CROSS-REFERENCE TO RELATED APPLICATIONS

This application claims priority of U.S. Provisional Patent Application 61/985,522 filed Apr. 29, 2014, the contents of which are incorporated herein by reference.

TECHNICAL FIELD

A flexible pouch having two separate compartments for holding complimentary substances, and a method for making said pouch are provided.

BACKGROUND OF THE INVENTION

Flexible pouches having dual compartments are currently known. Such flexible pouches include a first compartment and a second compartment separate from the first. However, such compartments are currently filled individually. Further, such pouches are not configured to be self-standing. Accordingly, it remains desirable to have a flexible pouch with two compartments wherein both compartments may be filled simultaneously and wherein the pouch may be self-standing.

SUMMARY OF THE INVENTION

A flexible pouch and a method for making a flexible pouch is provided. The pouch includes a pouch body defined by a peripheral edge. The peripheral edge is sealed so as to define a top seal edge, a bottom seal edge and a pair of side seal edges. A dividing seal is disposed between opposite ends of the flexible pouch so as to define two pouch spaces. The dividing seal extends from the top seal edge to the bottom seal edge. The pouch includes two fitments each of which are mounted to a respective pouch space. One of the fitments includes a base configured to support the pouch body in an upright manner.

A method for making a flexible pouch with two pouch spaces is also provided wherein the first step is forming a flexible pouch having an open top. The method includes the step of providing a dividing seal, the dividing seal extending from the open top to the bottom of the pouch so as to define two pouch openings and two pouch spaces within the pouch body. The method includes the step of introducing a first nozzle and a second nozzle into a respective first space and second space and filling the pouch body through the first and second nozzle. The method proceeds to the step of inserting a pair of fitments into a respective first pouch space and second pouch space. In the preferred embodiment a fitment having a flat head surface is mounted to a bottom surface of the pouch so as to support the surface in an upright manner. The method proceeds to the step of closing the open edge so as to form a pouch with two pouch spaces.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

A flexible pouch and a method for making a flexible pouch is provided. The pouch includes a pouch body defined by a peripheral edge. The peripheral edge is sealed so as to define a top seal edge, a bottom seal edge and a pair of side seal edges. A dividing seal is disposed between opposite ends of the flexible pouch so as to define two pouch spaces. The dividing seal extends from the top seal edge to the bottom seal edge. The pouch includes two fitments each of which are mounted to a respective pouch space.

The method for making the pouch includes the step of providing a pouch having an open top. The method proceeds to the step of sealing the pouch body so as to define a dividing seal separating the pouch body into a first pouch space and a second pouch space. The dividing seal extends from the open top to the bottom of the pouch. The method includes the step of introducing a first nozzle and a second nozzle into a respective first pouch space and second pouch space and filling the respective first and second pouch spaces through the first and second nozzle.

The method proceeds to the step of inserting a pair of fitments into a respective first pouch space and second pouch space. In the preferred embodiment a fitment having a flat head surface is mounted to a bottom surface of the pouch so as to support the surface in an upright manner. The method proceeds to the step of closing the open top so as to form a pouch with two pouch spaces.

Figure 1:
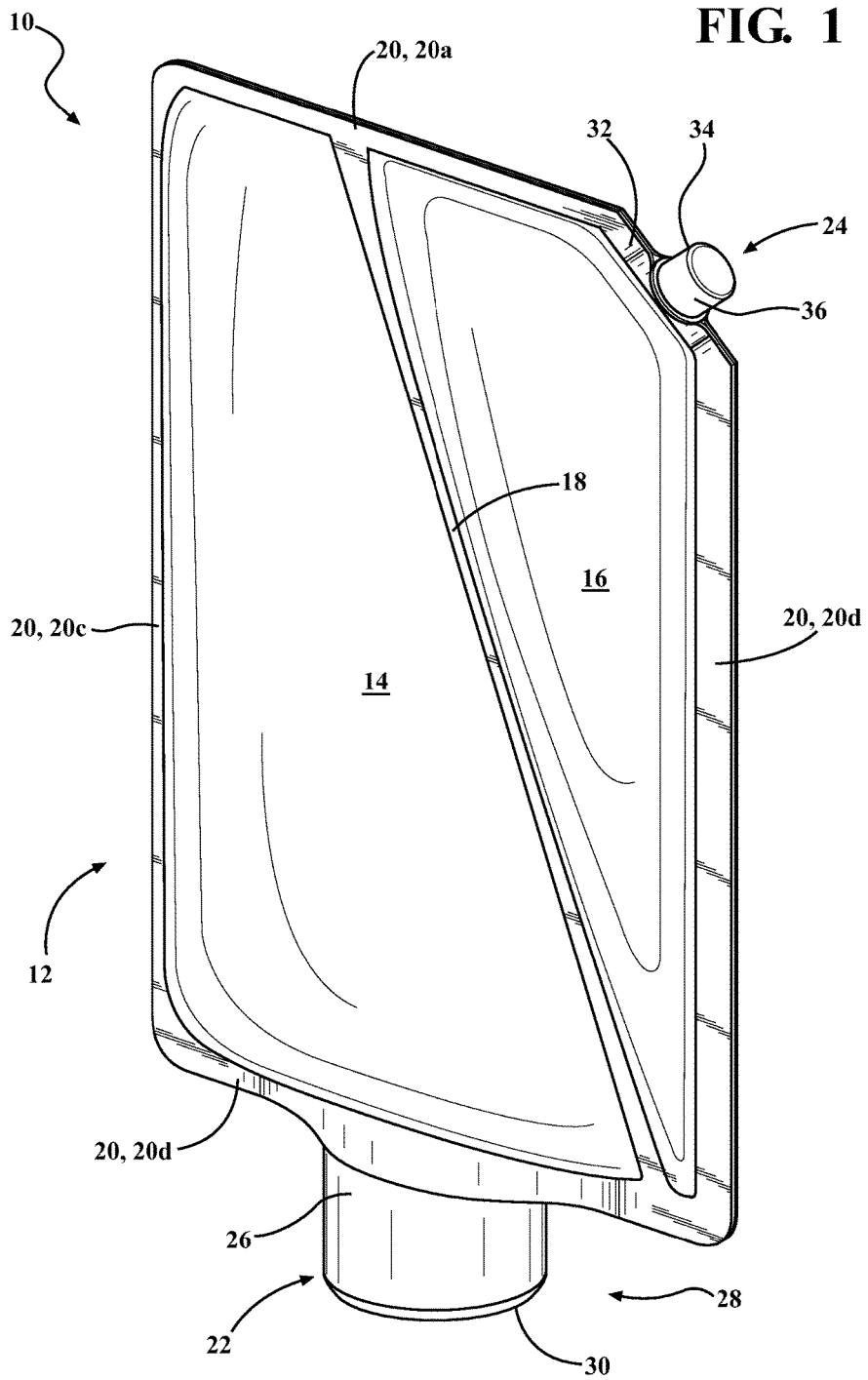
FIG. 1 is a perspective view the pouch.
Figure 2:
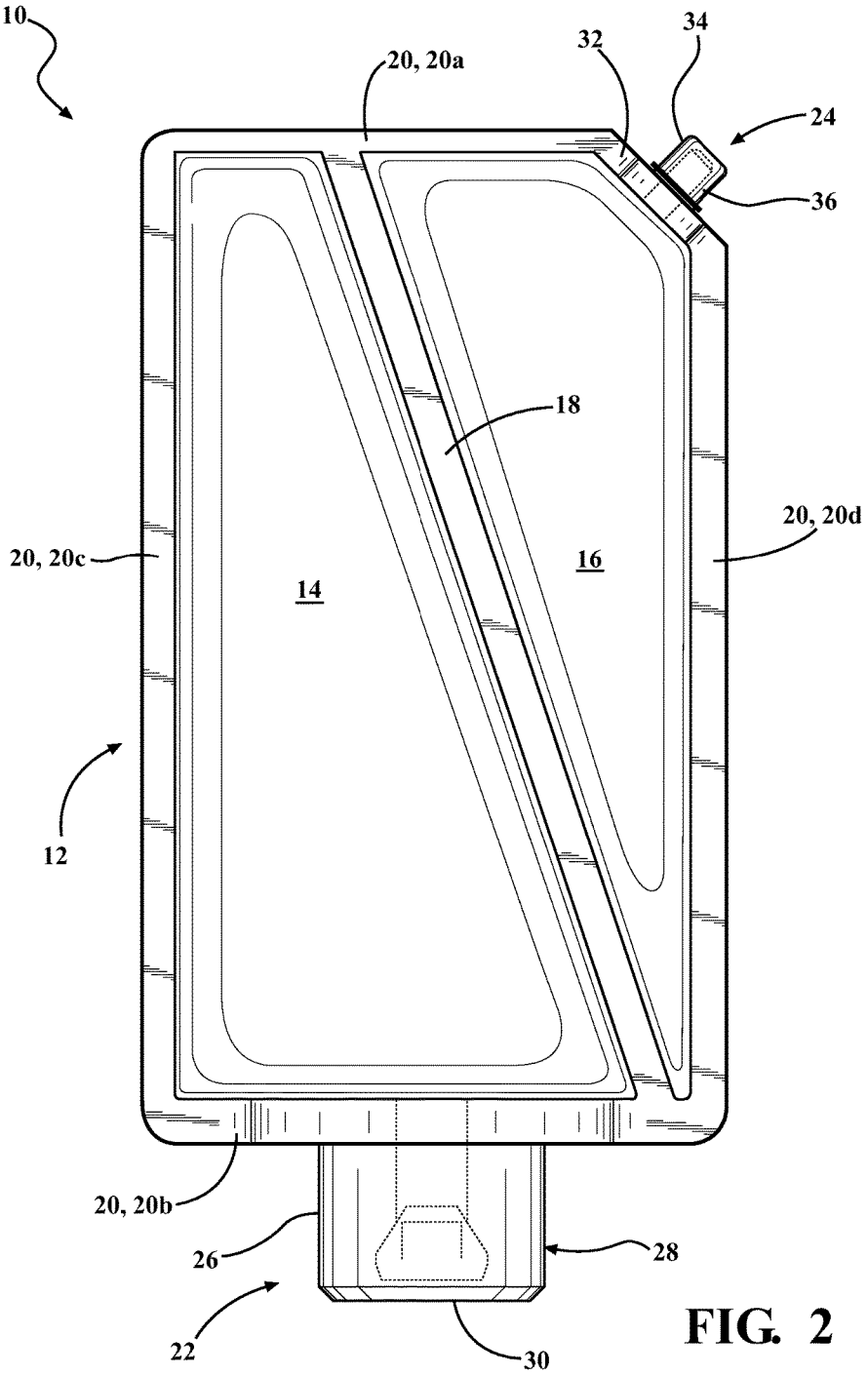
FIG. 2 is a side view of the pouch shown in FIG. 1.
Figure 5:
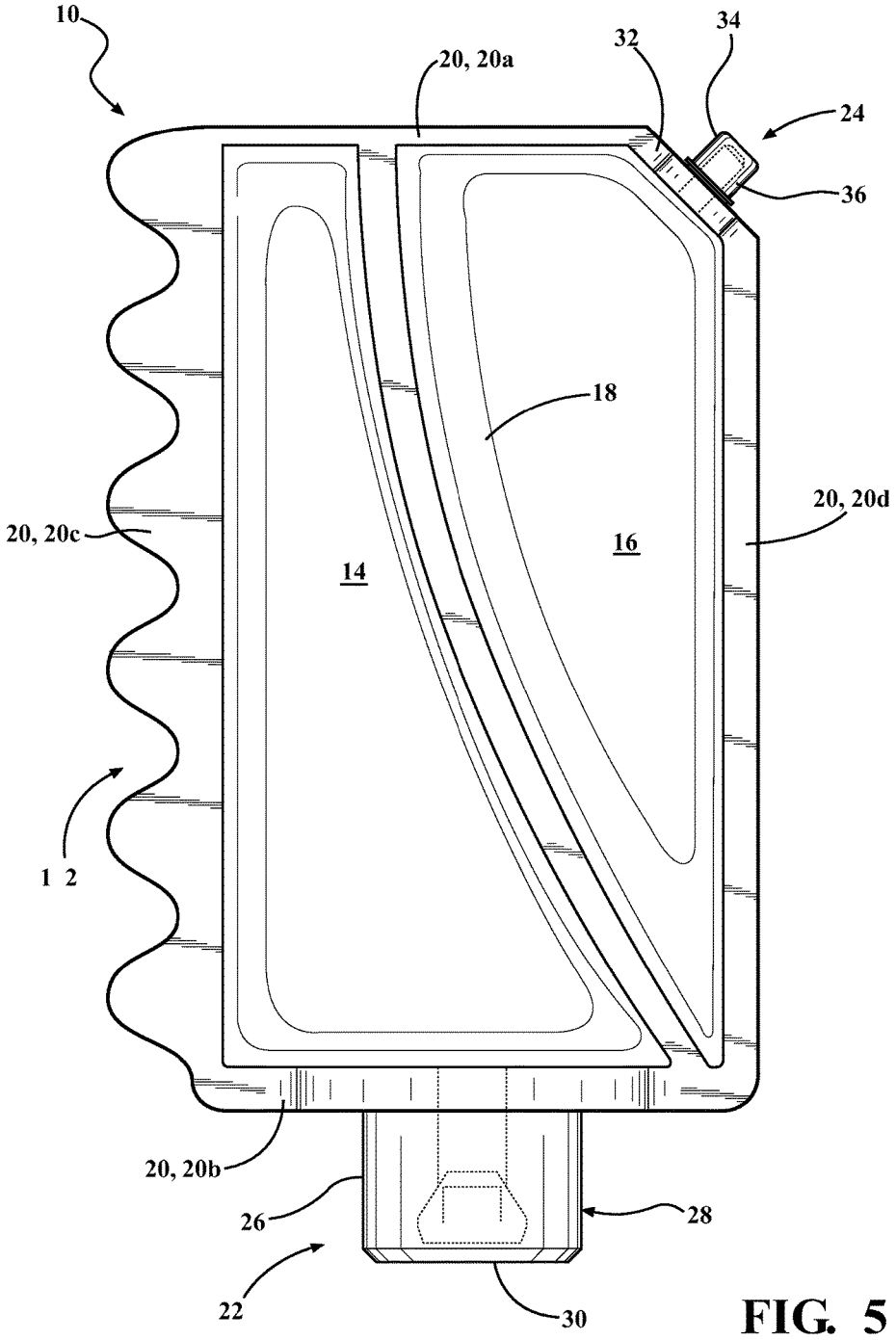
FIG. 5 is a perspective view of the pouch body showing a side edge having a contour dimension so as to facilitate the grip of the user.
Figure 6:
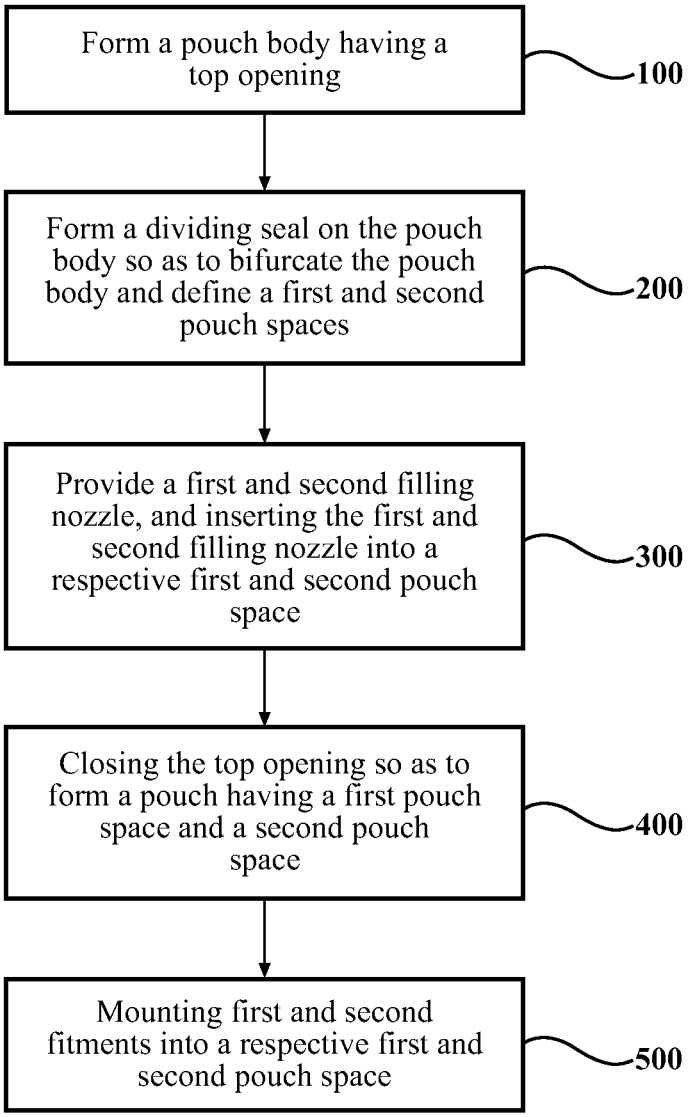
FIG. 6 is a diagram showing the method of forming a flexible pouch with two compartments.

With reference now to FIGS. 1, 2 and 5, an illustrative view of a flexible pouch 10 having a pouch body 12 with two pouch spaces 14, 16 is provided. The pouch spaces 14, 16 are separate spaces defined by a dividing seal 18.

The pouch body 12 includes a peripheral seal 20 defining and bounding the pouch body 12. The flexible pouch 10 may be formed from a laminate material, and the peripheral seal 20 may be formed by applying heat or an ultrasonic vibration to the edges of the laminate material. The peripheral seal 20 includes a top seal edge 20*a*, a bottom seal edge 20*b* and a pair of side seal edges 20*c*, 20*d*. The peripheral seal 20 is a generally flat and sheet of material extending outwardly from the sides of the pouch body 12 along axis W and along the length of the sides of the pouch body 12 along axis L.

The dividing seal 18 is formed on the pouch body 12 and extends between opposite ends of the pouch body 12 so as to define the first pouch space 14 and a second pouch space 16 separate from the first pouch space 14. The Figures show the dividing seal 18 extending from a top seal edge 20*c* to the bottom seal edge 20*d*. In particular, the dividing seal includes a top end 18*a* opposite a bottom end 18*b*. The top end 18*a* is sealed onto a portion of the top seal edge 20*a* so as to define two portions of the top seal edge 20*a*1 and 20*a*2. Likewise, the bottom end 18*b* is sealed onto a portion of the bottom seal edge 20*b* so as to define two portions of the bottom seal edge 20*b*1 and 20*b*2.

With reference again to FIGS. 1 and 2, an embodiment of the dividing seal 18 is provided, wherein the dividing seal 18 follows a generally straight line. However, it should be appreciated that the dividing seal 18 may be curved as shown in FIG. 2. Further, the dividing seal 18 may not necessarily be a generally axial elongated seal but may have spatial dimensions to facilitate a predetermined volumetric enclosure of a first and second pouch space 16. For instance, a midsection of the dividing seal 18 may be wider than the ends of the dividing seal 18.

The flexible pouch 10 may further include a first fitment 22 and a second fitment 24. As shown, the first fitment 22 is mounted to the bottom seal edge 20*b* of the pouch body 12 and is in communication with the first pouch space 14 so as to provide access to the contents within the first pouch space 14.

The first fitment 22 has a generally tubular neck 26 having a cylindrical opening which is in fluid communication with the inner spaces of the first pouch space 14 so as to allow access to the substances disposed within the first pouch space 14. The first fitment 22 may include a cap 28. The cap 28 is shown as what is commonly referred to as a flip-top. The cap has a bottom surface 30 configured to support the pouch body 12 in an upright manner. Preferably, the bottom surface 30 is planar. It should be appreciated that the first fitment 22 may have a cap 28 that is screwed on or engaged with the first fitment 22 in a snap fit arrangement (neither of which are shown) and that the attachment of the cap 28 to the first fitment 22 is provided for illustrative purposes and is not limiting to the scope of the flexible pouch 10 described herein.

The second pouch space 16 includes the second fitment 24. The second fitment 24 is shown sealed to an angled side edge 32 defining an edge between side seal edge 20*b* and the top seal edge 20*c* of the pouch body 12. The angled side edge 32 interconnects an end 20*a*3 of the top seal edge 20*a* to an upper end 20*d*1 of the side seal edge 20*d*. However, it should be appreciated that the second fitment 24 may be mounted to other portions of the second pouch space 16 so as to be in communication with the contents disposed within the second pouch space 16. The second fitment 24 has a generally tubular neck 34 having a cylindrical opening which is in fluid communication with the inner spaces of the second pouch space 16 so as to allow access to the substances disposed within the second pouch space 16. The second fitment 24 may also include a cap 36. The cap 36 is shown as what is commonly referred to as a snap on cap. However, it should be appreciated that the second fitment 24 may have a cap 36 that is screwed on or otherwise engaged with the second fitment 24, such as a flip-top arrangement (neither of which are shown). Accordingly, that the attachment of the cap 36 to the second fitment 24 is provided for illustrative purposes and is not limiting to the scope of the flexible pouch 10 described herein.

With reference again to FIG. 5, the peripheral seal 20 defining the sides of the pouch body 12 may include features to facilitate gripping of the pouch body 12. The peripheral seal 20 is generally a flat edge extending outwardly from the sides and top and bottom of the pouch body 12. Side seal edge 20*d* is shown as being generally straight on one side and side seal edge 20*c* is contoured. The contours are dimensioned to receive fingers and the grip of a user.

For illustrative purposes the pouch 10 may be filled with a first condiment and a second condiment complimentary to the first condiment, such as ketchup and mustard. The ketchup may be disposed in the first pouch 14 space and the mustard may be disposed in the second pouch space 16. However, it should be appreciated that the contents within a respective first and second pouch spaces 14, 16 are provided for illustrative purposes and is not limiting. For instance, the pouch spaces 14, 16 could be filled with salt and pepper. In such an embodiment it should be appreciated that the first and second fitments 22, 24 may be configured to accommodate the dispensing of salt or pepper.

With reference now to FIGS. 1, 2, 3, 4 and 6, a method for making a flexible pouch 10 having a pouch body 12 with two pouch spaces 14, 16 is provided. With reference first to FIG. 2, the method begins with step 100, forming a pouch body 12 from a sheet of laminate material wherein the sheet laminate material is sealed together so as to form a pouch body 12 having a pair of opposite side seals edges 20*c*, 20*d* and a bottom seal edge 20*b* and a top opening 38.

The method includes step 200, wherein a dividing seal 18 is formed on the pouch body 12. The dividing seal 18 extends between opposite ends of the pouch body 12 so as to define a first pouch space 14 and a second pouch space 16. The first pouch space 14 is separate from the second pouch space 16, and the first pouch space 14 includes a first top opening 38*a* and the second pouch space 16 includes a second top opening 38*b*. Though the dividing seal 18 is shown as being generally straight or arcuate in FIGS. 1 and 2 respectively, the dividing seal 18 may include other dimensions so as to assist in the weight distribution of the pouch when supported in an upright manner.

Figure 3:
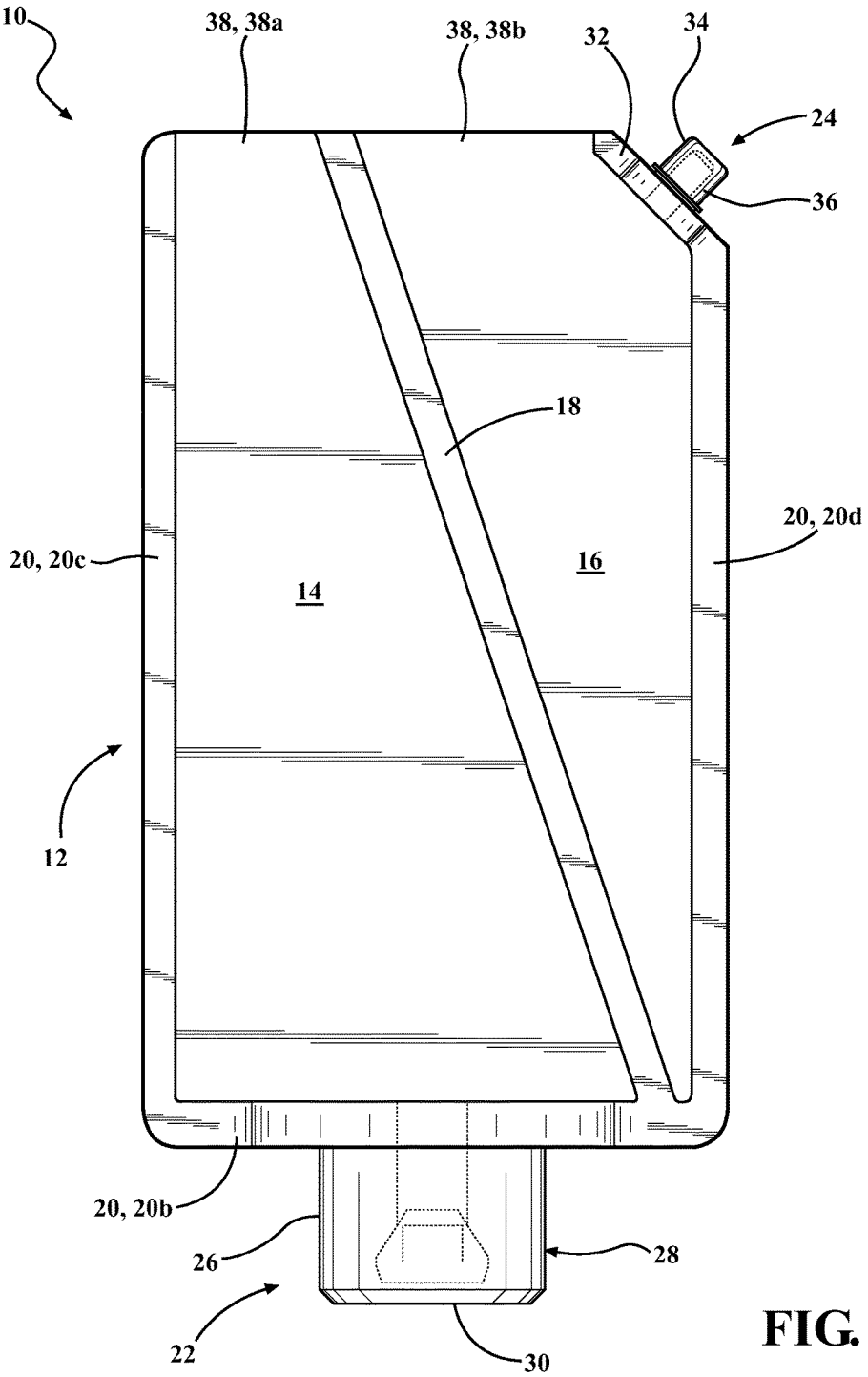
FIG. 3 is a perspective view the pouch showing the top opening.
Figure 4:
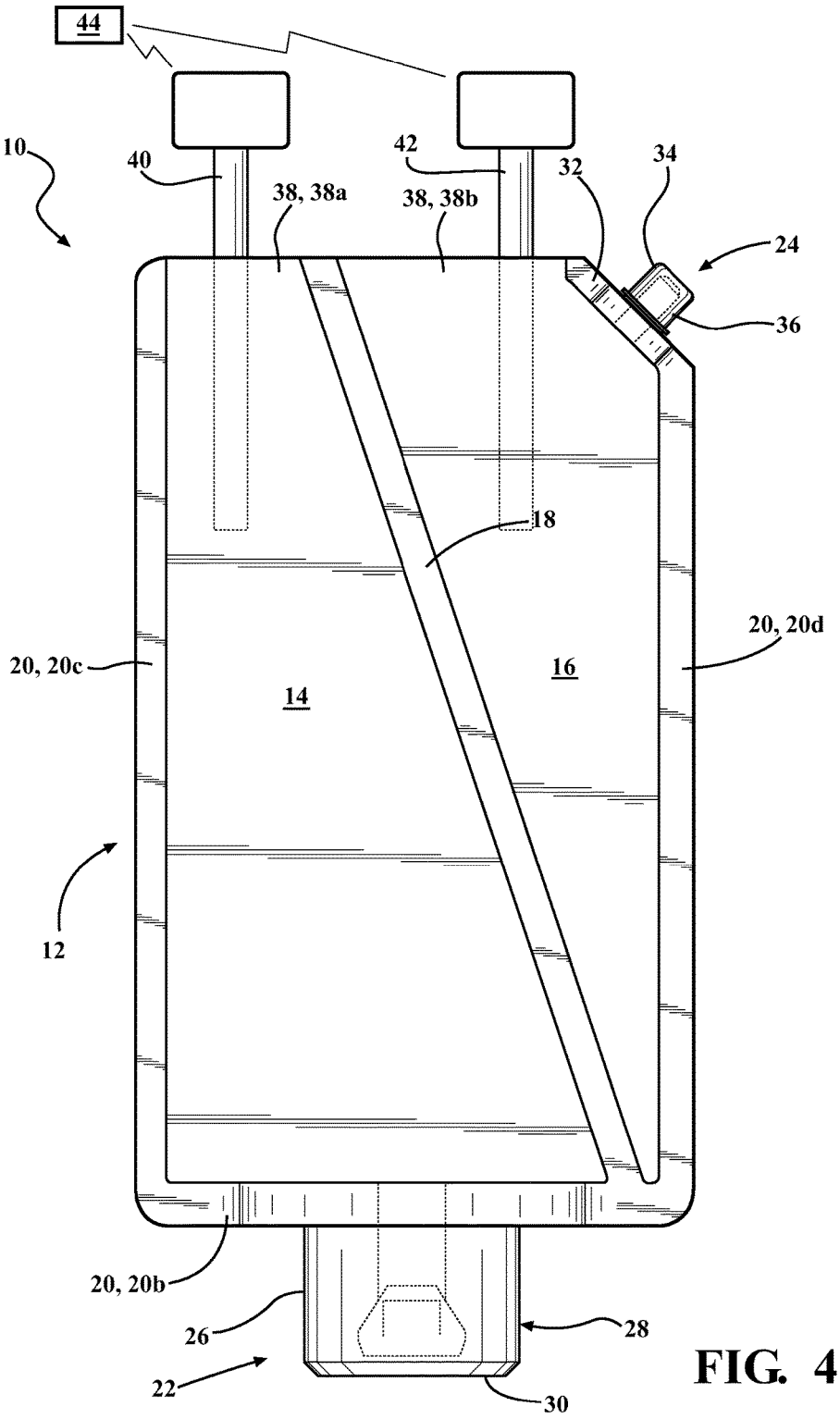
FIG. 4 is a perspective view showing the pouch body having an open end and a first and second nozzle disposed within the open end.

The method includes step 300 wherein a first and second nozzles 40, 42 are provided. The first and second nozzles are introduced into a respective first pouch space 14 and second pouch space 16, as shown in FIG. 3. The first and second pouch spaces 14, 16 may be filled simultaneously with a desired substance such as a condiment or a beverage. The first and second nozzles 40, 42 are in fluid communication with a supply of a respective condiment or beverage. The first and second nozzles 40, 42 may be automatically controlled by a programmable controller 44 so as to provide a desired amount of a respective condiment or beverage into a respective first and second pouch space 14, 16.

The first and second nozzles 40, 42 may be mounted to an adjustable frame/robotic arm (not shown) having a drive unit (not shown) configured to move the first and second nozzles in and out of the respective top openings 38*a*, 38*b*. The frame may be configured to move the first and second nozzles 40, 42 independent of each other or together as a unit. Alternatively, the first and second nozzles 40, 42 may be fixed, and an adjustable frame/robotic arm may be configured to hold the pouch 10 and move the pouch 10 into engagement with the first and second nozzles 40, 42.

The method proceeds to step 400 wherein the top opening 38 is closed with a top seal 20*a* so as to form a pouch 10 having a first pouch space 14 separate from a second pouch space 16, as shown in FIG. 1. The first and second pouch spaces 14, 16 are filled with a desired substance such as a condiment or a beverage.

The method may also include step 400, wherein a first and second fitments 22, 24 are mounted to respective first and second pouch spaces 14, 16. It should be appreciated that step 300 may be accomplished before or after the dividing seal 18 is formed, but preferable occurs before the first and second pouch spaces 14, 16 are filled.

While particular embodiments have been illustrated and described herein, it should be understood that various other changes and modifications may be made without departing from the spirit and scope of the claimed subject matter.

Moreover, although various aspects of the claimed subject matter have been described herein, such aspects need not be utilized in combination.

I claim:

1. A flexible pouch comprising:

a pouch body having a peripheral seal bounding the pouch body, the peripheral seal defining a top seal edge, a pair of side seal edges and a bottom seal edge;

a dividing seal extending across the pouch body so as to form a first pouch space and a second pouch space, wherein the second pouch space includes an angled side edge, the angled side edge interconnecting an end of the top seal edge to an upper end of one of the pair of side seal edges, the first pouch space being larger than the second pouch space, wherein the dividing seal extends across the pouch body so as to define a portion of the second pouch being elevated above a portion of the first pouch so as to assist in a distribution of the weight and support the pouch in an upright manner; and a first fitment and a second fitment, the first fitment in fluid communication with the first pouch space and mounted and centered to the bottom seal edge of the pouch body, the second fitment in fluid communication with the second space and mounted to the angled side edge of the pouch body so as to be opposite the first fitment, wherein the first fitment includes a cap, the cap has a bottom surface configured to support the pouch body in an upright manner, wherein the peripheral seal includes a top seal edge, a bottom seal edge and a pair of side seal edges, the dividing seal having a top end opposite a bottom end, the top end is sealed onto a portion of the top seal edge so as to define two portions of the top seal edge, the bottom end is sealed onto a portion of the bottom seal edge so as to define two portions of the bottom seal edge.

2. The flexible pouch as set forth in claim 1, wherein dividing seal is arcuate.

3. The flexible pouch as set forth in claim 1, wherein the bottom surface is generally planar.

4. The flexible pouch as set forth in claim 1, wherein the cap is a flip-top.

5. The flexible pouch as set forth in claim 1, wherein second fitment is sealed to the angled side edge.

6. The flexible pouch as set forth in claim 1, the pair of peripheral side seal edges is dimensioned to receive the grip of a user.

* * * * *